US005217139A

United States Patent [19]

Miczka, deceased et al.

[11] Patent Number: 5,217,139

[45] Date of Patent: Jun. 8, 1993

[54] DOME-SHAPED PRESSURIZED CAN

[76] Inventors: Franz L. Miczka, deceased, late of Appenzell; by Carl Burckhardt, executor, Schneideggstrasse 73, 8038 Zurich, both of Switzerland

[21] Appl. No.: 542,430

[22] Filed: Jun. 22, 1990

[30] Foreign Application Priority Data

Jun. 24, 1989 [DE] Fed. Rep. of Germany ..... 3920804
Jul. 29, 1989 [DE] Fed. Rep. of Germany ..... 3925211

[51] Int. Cl.[5] ..... B65D 30/10

[52] U.S. Cl. ..... 220/404; 222/95; 222/105; 222/286; 53/401; 53/470

[58] Field of Search ..... 220/404, 403; 222/95, 222/105, 286.5; 53/401, 470

[56] References Cited

U.S. PATENT DOCUMENTS

| | | | |
|---|---|---|---|
| 2,065,293 | 12/1936 | Scudder | 220/404 |
| 2,338,604 | 1/1944 | Silveyra | 220/404 |
| 3,129,867 | 4/1964 | Schroeder | 220/404 |
| 3,471,059 | 10/1969 | Moller et al. | 222/95 |
| 3,662,926 | 5/1972 | Umstead | 222/95 |
| 3,940,052 | 2/1976 | McHugh | 220/404 |
| 4,611,350 | 9/1986 | Kaczerwaski | 220/404 |
| 4,869,912 | 9/1989 | McCoy et al. | 220/404 |

*Primary Examiner*—Joseph Man-Fu Moy
*Attorney, Agent, or Firm*—Remy J. VanOphem

[57] ABSTRACT

A dome-shaped pressurized can contains a foil sack for holding a substrate, which is positioned in the can cylinder, whose upper edge is fastened in a welt connecting the can cylinder with a dome cover. The upper edge of the foil sack is clamped between the inner wall, the double cylinder and an adjacent edge of the dome and the clamped edge of the foil sack has a diameter which is larger than the diameter of the adjoining sack cylinder and rests on the inside of the can cylinder.

8 Claims, 4 Drawing Sheets

DOME-SHAPED PRESSURIZED CAN

BACKGROUND OF THE INVENTION

The invention relates to a dome-shaped pressurized can with a foil sack for holding a substrate which is positioned in the can cylinder. The invention also relates to a method for producing this type of pressurized can.

Pressurized cans with foil sacks are based on the principle of preventing the substrate contained in the foil sack from mixing with a pressurized gas which is necessary for ejecting the substrate from the pressurized can. This is intended to prevent impairment of the substrate properties and also provide a way to keep harmful propellants in the can or replace them with environmentally safe propellants. In the pressurized can according to the invention, the foil sack can contain a substrate made of a prepolymer with a foaming agent which is propelled from the can, forming a constructive polyurethane foam, with the aid of one of the environmentally safe gases instead of freon, which has often been used as the propellant but is now questionable for environmental reasons.

The invention is not limited to a particular substrate in the foil sack and can use the propellant suitable in each case. This is guaranteed primarily by the great strength of the junction between the dome and the cylinder in dome-shaped pressurized cans. This junction withstands a pressure of, for example, 24 bar. This junction is normally a multiple welt formed by the flange between the can cylinder, which can consist of a tin-plate sheet, and the groove of the dome, which can also consist of a tin-plate sheet, with these metal parts being folded over and underneath one another toward the outside. With present multiple welts, a flat gasket is placed on the groove base of the dome and incorporated into the external multiple welt. It withstands the pressure of the propellant used to eject the substrate from the can. In dome-shaped pressurized cans of this type, the propellant does not come into direct contact with the flat gasket. This prevents the propellant from entering the foil sack from above and mixing with the substrate.

The invention is not limited to a particular propellant. In particular, inert propellants such as carbon dioxide or nitrogen and solutions thereof can be used in addition to the propellants mentioned above, which are placed in liquid form between the foil sack and the pressurized can. The pressurized can according to the invention not only withstands the considerable pressure of the propellant but also prevents it from mixing with the substrate. The can also has the necessary junction strength between the foil sack and the multiple welt. Such stresses result from mechanical load on the junction, which is particularly high when the can is filled with the substrate through an opening in the dome, later to be closed by a valve, because the substrate is normally loaded through impact-producing means. Stress can also be produced by occasional pressure differences between the propellant chamber, which is located between the foil sack and the pressurized can, and the sack cavity, thereby subjecting the junction between the sack and the pressurized can to stress.

The high demands placed on the junction between the foil sack and the can welt have been taken into account through various means in known dome-shaped pressurized cans, although not to a sufficient degree.

With multiple welts, for example, the top edge of the foil sack is known to be placed in the multiple welt, extending beyond the inner welt edge until it reaches a position between the metal parts of the welt. However, this has proved to overload the sack foil in the welt. The resulting foil deformations do not provide a sufficient seal between the propellant and the substrate in the foil sack. According to a different proposal, on the other hand, drawing the top edge of the foil sack over only the can flange can create the seal only by using additional, i.e. inserted, seals. This makes the manufacturing process considerably more difficult and expensive. Moreover, it cannot guarantee the mechanical strength of the sack junction.

SUMMARY OF THE INVENTION

The invention is based on the goal of creating a pressurized can of the type mentioned above which guarantees adequate strength and pressure-tightness between the foil sack and the multiple welt on the can dome.

According to the invention, the junction between the foil sack and the pressurized can is positioned only between the inner cylindrical groove edge on the dome and the cylindrical edge of the pressurized can, and the top edge enclosed by these two parts also remains cylindrical. The free side of the foil edge rests in the groove, which ensures that the outside of the foil edge rests on the inside of the can edge. It has been discovered that this considerably shorter and solely force-closed method of attaching the foil edge to the can edge, compared to known junctions, guarantees the necessary strength, which is equivalent to or in excess of the sack strength, so that failure or partial failure of the junction between the sack and the pressurized can does not occur until the foil sack is overstressed. This also achieves the necessary pressure-tightness to prevent propellent losses even when the can is stored for long periods of time. The invention eliminates mechanical overstress occurring on the top foil edge which was previously produced by deformation of the sack edge and forced by the latter when it was incorporated or partially incorporated into the multiple welt. In addition, the foil edge resting on the inside of the can edge acts as a seal. It is adequate for this purpose, so that a flat gasket of the known type is not necessary. However, it can also act together with the known flat gasket.

The invention has an advantage in that it ensures an absolutely pressure-tight and adequate mechanically resistant junction between the foil sack and the top, dome-shaped edge of the can, thereby establishing the conditions for long-term packing of the substrate, even if the latter is sensitive to penetrating propellant, and if highly pressurized propellants must be used, without resulting in pressure losses when stored over long periods of time.

According to the invention, there are a number of ways in which the sack edge can be clamped between the can cylinder and the dome edge and still ensure that a space for filling the compressed gas remains between the foil sack and the cylindrical wall of the pressurized can, and not merely beneath the foil sack base. These methods of clamping the sack edge are particularly suitable for propellants which are not liquid under the usual propellant pressures and, therefore, require a relatively large amount of space.

According to a further feature of the invention, the necessary sealing power and strength of the junction is achieved, even if a metal foil is used for the sack. Unlike most plastic films, metal foils are impenetrable to propellant diffusion and, therefore, protect the substrate contained in the foil sack against negative effects of the propellant. Coating both sides of the metal foil with a thermoplastic material is advantageous in that such foils can be welded, since heat causes the coating materials to flow together.

It is a further object of the present invention to provide a method of manufacturing the pressurized can according to the invention.

These and other features and advantages of the invention will become apparent upon reading the following detailed description thereof in conjunction with the appended drawings.

DETAILED DESCRIPTION OF THE PREFERRED EMBODIMENT

Figure 5:
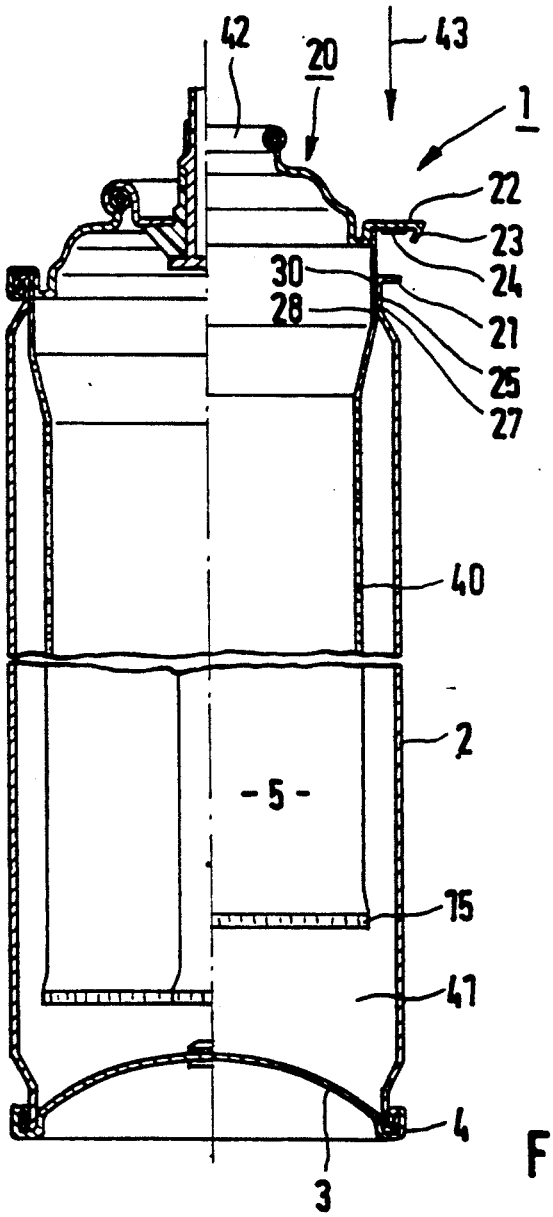
FIG. 5 is a partial cross-sectional view of the parts of the pressurized can before attaching the dome by connecting the foil sack with the can cylinder.

A pressurized can 1 according to FIG. 5 has a separately manufactured can cylinder 2. The can cylinder can be formed from a tin-plate metal blank which is rolled into a cylindrical shape and welded along its longitudinal edges. The lower part of FIG. 5 shows a base 3 formed from a circular blank which is connected to a dome-shaped edge 4 on the can cylinder. The pressurized can contains a foil sack 5 in which the substrate will later be placed.

Figure 1:
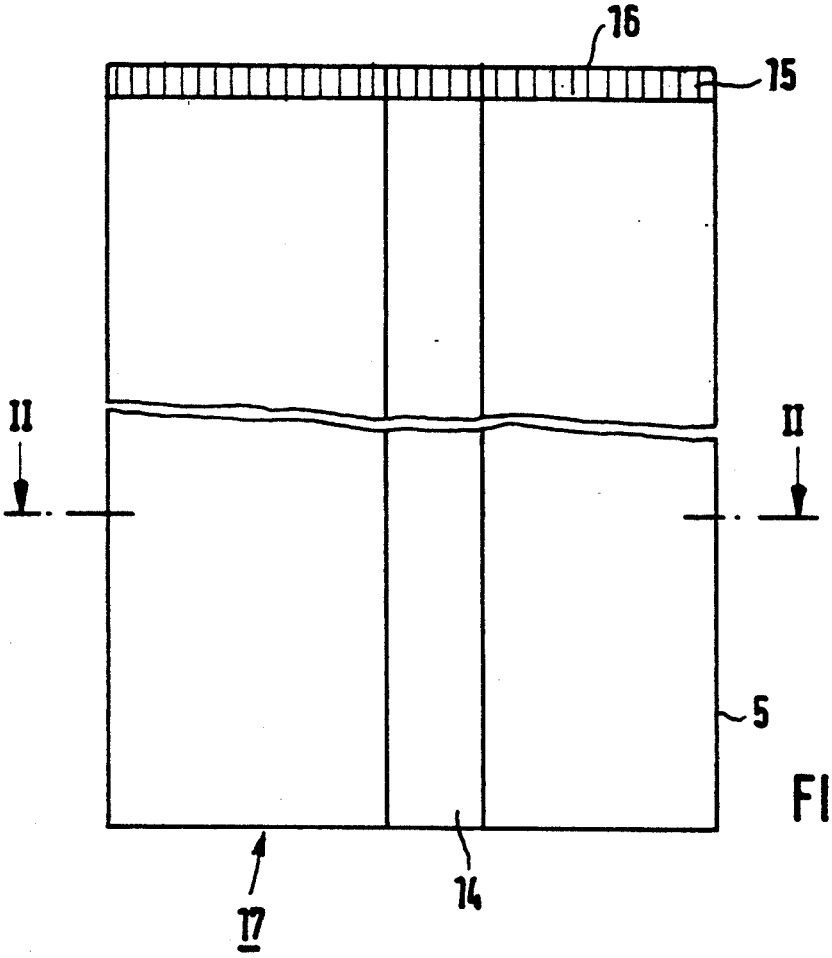
FIG. 1 is a perspective view of a foil sack used in the pressurized can according to the invention.
Figure 2:
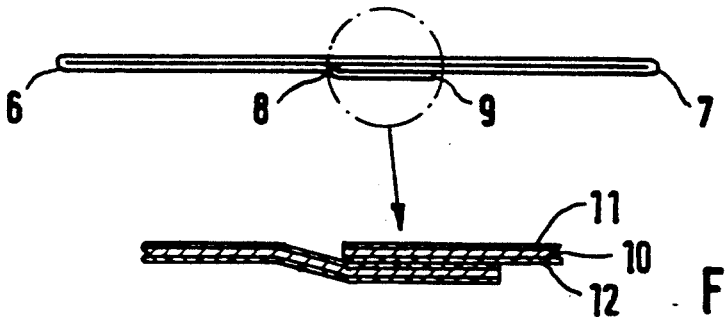
FIG. 2 is a sectional view of the foil sack taken along line II—II of FIG. 1.

According to FIGS. 1 and 2, the foil sack 5 is welded from a foil sheet. The foil sheet is folded along parallel edges 6 and 7, and its side edges 8 and 9 placed on top of one another. The foil sheet consists of a metal foil 10 both sides of which are coated at 11 and 12 with a thermoplastic material. An aluminum foil is suitable for the metal foil, while polypropylene can be used as the coating material. The coating materials are joined under pressure and heat along the longitudinal seam 14 shown in FIG. 1.

While the foil material is removed from a roll and folded along the parallel edges 6 and 7, it is welded laterally at 15, as shown in FIG. 1. The foil sacks are separated along an edge 16.

Figure 4:
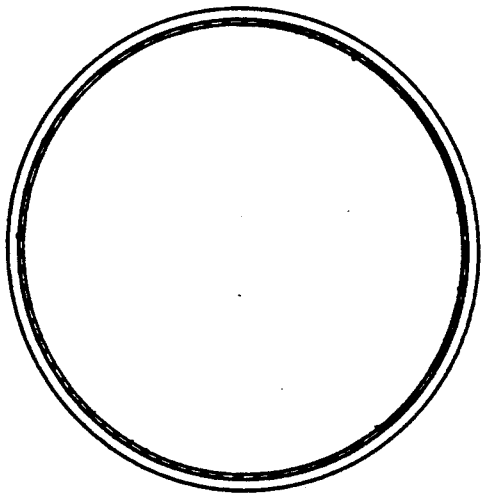
FIG. 4 is a sectional view of the foil sack of taken along line IV—IV thereof FIG. 3.

In a further step in the procedure, an open side 17 of each foil sack is placed over a mandrel which forms the flat sack according to FIG. 2 into the cylinder illustrated in FIG. 4.

Figure 3:
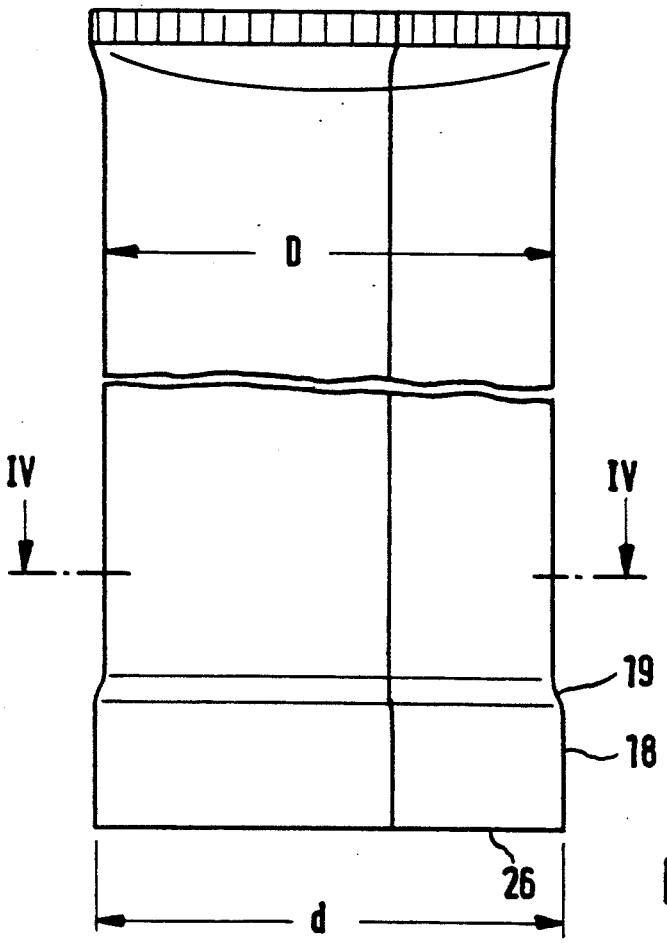
FIG. 3 shows the foil sack according to FIGS. 1 and 2 after it has been prepared for placement in the can cylinder.

According to FIG. 3, the upper edge of the foil sack surrounding the open side 17 is widened, i.e. its diameter (d) is larger than diameter (D) of the foil segment adjoining the edge. The transition from diameter (D) to diameter (d) is more or less conical and illustrated at 19.

The can cylinder 2 is fitted with a smooth flange 21 in order to prepare the junction with a dome-shaped upper part 20. The dome 20 also has a smooth flange 22 whose external edge 23 is bent inward, i.e. over the flange 22. The lower and inner sides of the flange 22 have a flat gasket 24 which correspondingly is placed in a groove with a cylindrical inner wall 25.

After being formed into the shape illustrated in FIGS. 3 and 4, the foil sack 5 is placed in the can cylinder so that its top edge 18 projects over the flange 21 until the upper edge 26 of the foil sack 5 meets the flat gasket 24 when the dome 20 is set in place from above. In this position, the foil sack 5 is held in place when the outside of the top edge 18 is force-closed with the inside of the can cylinder. These areas are marked 27 and 28 in FIG. 5.

Figure 6:
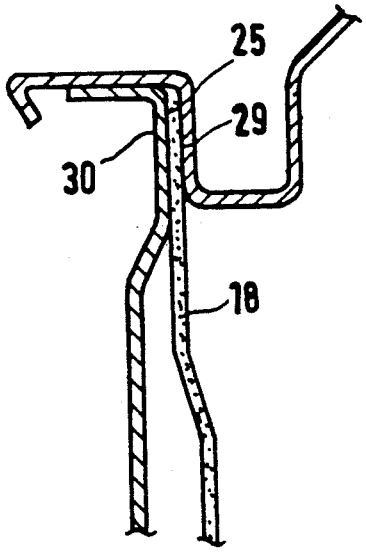
FIG. 6 is a partial representation of the object of FIG. 5 in the region of the upper can edge, before the can is formed in the shape of a dome.
Figure 7:
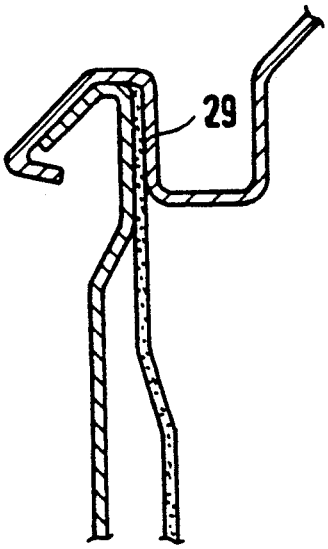
FIG. 7 illustrates a multiple welt according to the invention before it is finished.
Figure 8:
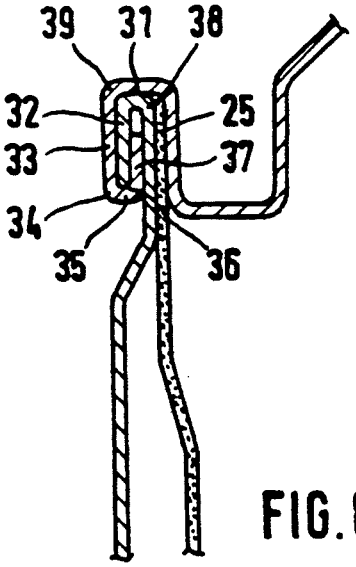
FIG. 8 is a representation corresponding to FIGS. 6 and 7 of the multiple welt on the finished dome-shaped can.

In the next step, the dome 20 is moved down in the direction of the arrow 43. It has been discovered that the formed rigidity of the structure illustrated in FIG. 3, particularly of the upper sack edge 18, is great enough to push the foil sack 5 into the inner cavity of the can cylinder once the upper edge 26 comes to rest on the flat gasket 24, thereby producing the final can illustrated in FIG. 6. The upper section of the edge 18, which is marked 29, is enclosed between the cylindrical groove wall 25 and a cylindrical can edge 30, which lies directly beneath the flange 21 in the can cylinder 2. This is the original state of the can before the dome-shaping procedure is carried out. As best illustrated in FIG. 8, the groove base 31, and therefore the flat gasket and the groove wall 23 bent backward onto the flange 22, is folded into the single-bend flange 21 of the can cylinder. This is done by folding the parts several times as indicated at 32 through 39, as shown in FIG. 8. By doing this, the cylindrical shape of the inner groove wall 25 is retained. The cylindrical can edge 30 also remains the same. As a result, the upper section 29 of the edge 18 of the sack 5 is not deformed.

At the end of the dome-shaping procedure, the interfolded metal strips are pressed together and assume the shape illustrated in FIG. 8. This clamps the upper section 29 between the adjacent metal parts, i.e. between the cylindrical groove wall 25 and the cylindrical can edge 30. The thermoplastic coatings 11 and 12 are thus set under pressure and act as seals.

The shape of the foil sack 5 described in connection with FIGS. 3 and 4 produces a cavity 41 in the finished can into which a propellant is injected, which is positioned beneath the cross weld 15 and the base 3 as well as between the can cylinder 2 and the sections of the foil sack lying beneath the widened upper portion of the sack indicated at 19 and generally marked 40 in FIG. 5. The propellant is generally injected through a recess in the base 3 of the can cylinder once the substrate has been injected into the foil sack through the top opening 42 in the dome. The top opening 42 is then closed by a valve insert through which the substrate is later ejected.

We claim:

1. A pressurized can comprising:

a can body formed as a hollow member with an interior surface, said can body having an upper end which is open and an oppositely disposed closed end, said upper end having an upper edge associated therewith, said can body having an upper interior surface adjacent said upper edge;

an upper cover secured to said upper end of said can body, said upper cover having a peripheral edge, said upper cover having a surface adjacent said peripheral edge;

a welt attaching said upper cover to said upper end of said can body, said welt joining said upper interior surface of said can body with said surface of said upper cover;

a sack positioned in said pressurized can, said sack being adapted for holding a fluid within said can body, said sack having a top edge secured in said welt, said top edge of said sack being clamped between said upper interior surface of said can body and an adjacent portion of said surface of said upper cover; and a propellant agent disposed within said pressurized can, said propellant agent being isolated from said fluid by said sack.

2. The pressurized can according to claim 1, further comprising:

a flange extending from said upper edge of said can body; and an annular groove disposed on said peripheral edge of said upper cover, said annular groove having a flat gasket portion and an outer edge portion;

wherein said welt is a multiple welt formed by said flange and said outer edge portion of said annular groove, and wherein said top edge of said sack abuts said flat gasket portion of said annular groove.

3. The pressurized can according to claim 1 wherein said top edge of said sack forms one end of a truncated cone-shaped sack jacket, said top edge having a larger diameter than a lower adjacent portion of said sack, said cone-shaped sack jacket resting against said upper interior surface of said can body.

4. The pressurized can according to claim 1 wherein said top edge of said sack lies in a plane which is transverse to a longitudinal axis of said sack.

5. The pressurized can according to claim 1 wherein said upper end of said can body has a cylindrical reduced portion, and wherein said top edge of said sack has an enlarged diameter portion which contacts said cylindrical reduced portion of said can body.

6. The pressurized can according to claim 1 wherein said sack is coated on opposing surfaces with a thermoplastic material, said thermoplastic material forming a seal at said top edge of said sack between said upper edge of said can body and said peripheral edge of said upper cover.

7. A method for forming a pressurized can comprising the steps of:

inserting a sack within a hollow can body until an upper edge of said sack projects over a flange at an adjacent end of said hollow can body;

placing a cover having a radial flange on said hollow can body such that said radial flange engages said upper edge of said sack;

installing said cover on said hollow can body so as to simultaneously further insert said sack into said hollow can body until said flange of said hollow can body abuts said radial flange of said cover;

forming a multiple welt by pressing said flange of said hollow can body and said radial flange of said cover together; and introducing a pressurizing agent into said hollow can body.

8. The method according to claim 7, wherein said step of installing said cover on said hollow can body is opposed by frictional resistance provided by said upper edge of said sack having a transitional cone adjacent said upper edge of said sack such that said transitional cone engages an inside surface of said hollow can body.

* * * * *

UNITED STATES PATENT AND TRADEMARK OFFICE

CERTIFICATE OF CORRECTION

PATENT NO. : 5, 217,139

DATED : June 8, 1993

INVENTOR(S) : Miczka, deceased et al.

It is certified that error appears in the above-identified patent and that said Letters Patent is hereby corrected as shown below:

Column 3, line 25, after "of" second occurance insert ----FIG. 3--.

Column 3, line 26, delete ---- "FIG. 3" ----.

Column 3, line 35, after ";" insert ---- and ----.

Column 4, line 29, after "the" second occurance insert ---- top

Column 4, line 60, delete "the" second occurance and insert ---- a

Column 6, line 10, after "is" insert ---- made from a metal coil

Signed and Sealed this

Fifth Day of April, 1994

Bruce Lehman

*Attest:*

BRUCE LEHMAN

*Attesting Officer*

*Commissioner of Patents and Trademarks*